US007997660B2

(12) United States Patent
Monyak et al.

(10) Patent No.: US 7,997,660 B2
(45) Date of Patent: Aug. 16, 2011

(54) HYBRID RETAINER SLEEVE FOR TOOL INSERTED INTO BLOCK

(75) Inventors: Kenneth Monyak, Abingdon, VA (US); Daniel Mouthaan, Williamsburg, MI (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 316 days.

(21) Appl. No.: 12/202,540

(22) Filed: Sep. 2, 2008

(65) Prior Publication Data

US 2009/0058173 A1 Mar. 5, 2009

Related U.S. Application Data

(60) Provisional application No. 60/935,851, filed on Sep. 4, 2007.

(51) Int. Cl.
*E21C 35/197* (2006.01)

(52) U.S. Cl. ..... 299/107

(58) Field of Classification Search ..... 299/107, 299/106

See application file for complete search history.

(56) References Cited

U.S. PATENT DOCUMENTS

| | | | | |
|---|---|---|---|---|
| 3,865,437 | A * | 2/1975 | Crosby | 299/107 |
| 4,084,856 | A | 4/1978 | Emmerich et al. | |
| 4,484,783 | A | 11/1984 | Emmerich | |
| 4,575,156 | A * | 3/1986 | Hunter et al. | 299/107 |
| 4,684,176 | A | 8/1987 | Den Besten et al. | |
| 4,763,956 | A * | 8/1988 | Emmerich | 299/107 |
| 5,302,005 | A | 4/1994 | O'Neill | |
| 5,303,984 | A | 4/1994 | Ojanen | |
| 5,503,463 | A | 4/1996 | Ojanen | |
| 7,234,782 | B2 | 6/2007 | Stehney | |

FOREIGN PATENT DOCUMENTS

DE 24 58 485 C3 6/1976

* cited by examiner

*Primary Examiner* — John Kreck
(74) *Attorney, Agent, or Firm* — Drinker Biddle & Reath LLP

(57) ABSTRACT

A sleeve utilizing two methods of retention—a friction fit and a rear retention feature—is disclosed. The sleeve includes a circumferentially compressible portion that provides a friction fit when inserted into a bore and includes a projected portion around an end circumference that is used to mate with the rear of a tool block and urges the sleeve (and the tool) rearward. The disclosure also relates to a tool and block assembly, a method of retaining a tool in a holder and a mining machine incorporating the sleeve.

20 Claims, 1 Drawing Sheet

HYBRID RETAINER SLEEVE FOR TOOL INSERTED INTO BLOCK

RELATED APPLICATION DATA

This application claims priority under 35 U.S.C. §119(e) to U.S. Provisional Application No. 60/935,851, filed Sep. 4, 2007, entitled "Hybrid Retainer Sleeve For Tool Inserted into Block", the entire contents of which are incorporated herein by reference.

FIELD

The present disclosure relates to a sleeve for retaining a tool in a block. More particularly, the present disclosure relates to a retainer sleeve that fits about the shank of a tool and is inserted into a bore of a block to form an assembly. The retainer sleeve incorporates both a friction fit and a rear retaining feature.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Mining and construction machines are being designed with progressively faster cutter drum and chain speeds. These advancements are making it more difficult to retain tools in their respective holders, such as a tool block or a bore of a rotating drum. For this reason, friction sleeve retainers are becoming less effective in retaining tools. Many industries are starting to progress towards rear retention to hold tools in holders.

Rear retainers are typically used in applications where the user needs maximum retention. These retainers are separate, loose parts that are inserted in a retaining feature, such as a groove, on the portion of the tool shank that projects beyond the rear of the tool block.

Rear retainers have certain limitations. Rear retainers can be difficult to assemble and remove due to limited access behind the holder. In order to assemble a typical external retainer onto a tool, a certain amount of clearance is required between the rear of the holder and the groove in the tool shank. This clearance can allow unnecessary freedom of movement between the tool and holder, causing an unwarranted amount of slapping between the tool shoulder and face of the holder. This slapping can cause excessive wear in the bore and on the face of the holder, reducing the lifetime of both parts.

Certain retainers require special tools (for example, snap rings require special pliers) while others require excessive force (for example, cut washers) during installation and removal. Due to the elastic memory of these retainers, during removal many retainers are prone to "pop" off in any given direction. This can make the removal of these "projectile" retainers dangerous on the job site as well as cumbersome to use if one loses the retainer and needs to find a replacement.

SUMMARY

An improved sleeve utilizing two methods of retention—a friction fit as well as a rear retainer—has advantageous performance characteristics as well as improved ease of use.

An exemplary embodiment of a sleeve for retaining a tool in a block comprises a hollow cylindrical body having a first end, a second end and a connecting surface therebetween arranged axially, a first axially extending slit in the connecting surface extending from the first end to the second end, at least one second axially extending slit in the connecting surface extending from the second end to a termination point between the first end and the second end, and a projected portion offset from the second end, wherein the sleeve at the projected portion projects radially outward with a radius larger than a radius of an outer diameter of the hollow cylindrical body, and wherein the termination point is axially closer to the first end than the projected portion.

Another exemplary embodiment of a sleeve for retaining a tool in a block comprises a hollow cylindrical body having a first end, a second end and a connecting surface therebetween arranged axially, a plurality of sections arranged circumferentially at the second end, and a projected portion offset from the second end, wherein the hollow cylindrical body is circumferentially compressible, and wherein each of the plurality of sections is independently radially compressible.

An exemplary embodiment of a mining machine comprises a rotatable member, and one or more tools mounted on the rotatable member, wherein the one or more tools are mounted with a sleeve including a hollow cylindrical body having a first end, a second end and a connecting surface therebetween arranged axially, a plurality of sections arranged circumferentially at the second end; and a projected portion offset from the second end, wherein the hollow cylindrical body is circumferentially compressible, and wherein each of the plurality of sections is independently radially compressible.

An exemplary embodiment of a tool and block assembly comprises a block including a body having a bore extending axially from a first side to a second side, a tool including a body having a head and a shank, and a sleeve positioned about the shank, wherein the sleeve includes a hollow cylindrical body having a first end, a second end and a connecting surface therebetween arranged axially, a plurality of sections arranged circumferentially at the second end, and a projected portion offset from the second end, wherein at least a portion of the connecting surface has a friction fit with the bore, wherein the projected portion contacts the block to urge the sleeve rearward, and wherein the tool is rotatable.

An exemplary embodiment of a method of mounting a rotatable tool in a bore of a holder comprises securing the tool in the bore with a sleeve that provides both a friction fit and a rear retention feature.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
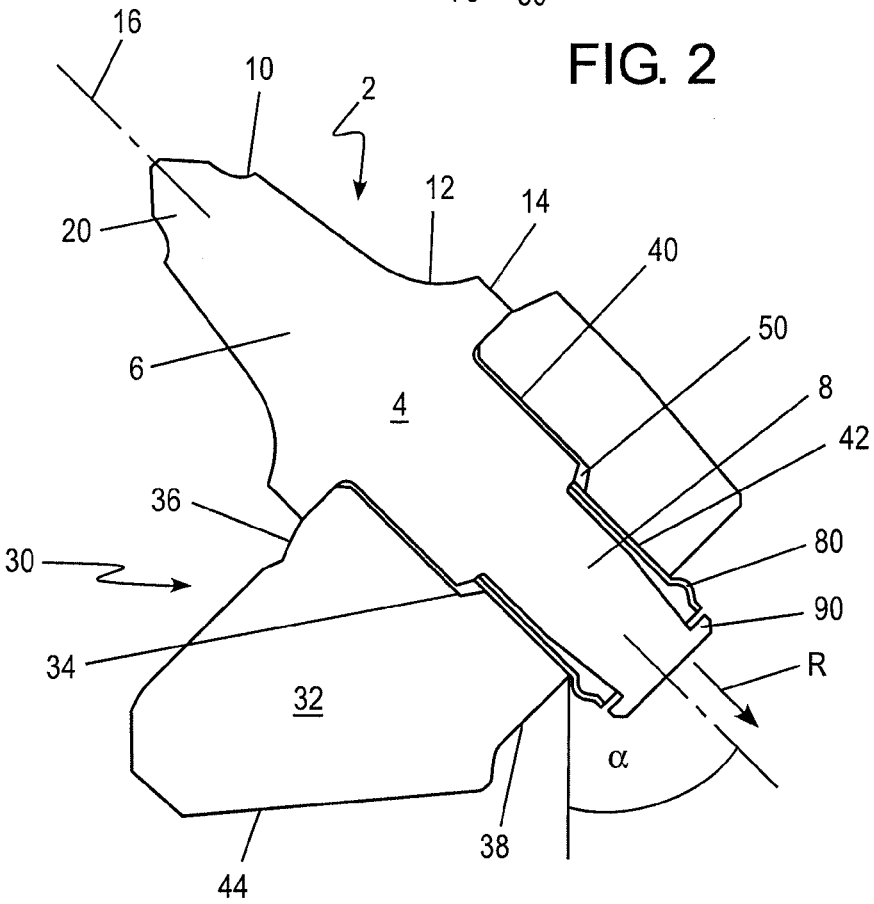
FIG. 1 is a cross-sectional view of an exemplary embodiment of a tool assembly including a tool, a hybrid retainer and a holder.

An exemplary embodiment of a tool in a block is schematically illustrated in FIG. 1. The tool 2 includes a body 4 having a head 6 and a shank 8. The head 6 includes a front surface 10 and a side surface 12. The side surface 12 extends axially rearwardly from the front surface 10 toward a shoulder 14. The side surface 12 can be of various forms from being oriented substantially perpendicular to a central axis 16 of the body 4 to being oriented at an angle $\alpha$ to the central axis 16 (the angle $\alpha$ opening rearward), and combinations thereof and the form of the side surface 12 can be planar, concave, convex or combinations thereof. The side surface shown in FIG. 1 is an example of a concave form. A cutting tip 20 is attached to the front surface 10 of the head 6. The cuffing tip 20 is made from a hard material. A suitable hard material for the cutting tip 20 is cemented carbide. An exemplary composition of the cemented carbide includes 6-12 wt. % Co and balance WC.

The block 30 can have any suitable shape, generally adapted to the mining machine on which it is mounted and adapted to the tool which it supports. An exemplary embodiment of a block 30 includes a body 32 having a bore 34 extending axially from a first side 36 to a second side 38. The bore 34 can be smooth along its inner diameter, albeit the bore 34 can be stepped, i.e., have variation in the inner diameter along its length, or the bore 34 can include an internal groove. An example of a stepped bore is shown in FIG. 1 with a first portion 40 and a second portion 42. Other stepped bore arrangements are disclosed in U.S. Pat. Nos. 7,234,782 and 5,302,005, the entire contents of which are incorporated herein by reference. An example of a bore with an internal groove is disclosed in U.S. Pat. No. 4,484,783, the entire content of which is incorporated herein by reference. The block 30 has a mounting surface 44 at a third side. The mounting surface 44 is adapted for mounting to a rotatable drum of a mining machine or other rotatable member of a construction machine, tunneling machining or trenching machine, such as Sandvik model MT720 tunneling machine or Voest-Alpine's Aline Bolter Miner ABM 25.

Figure 2:
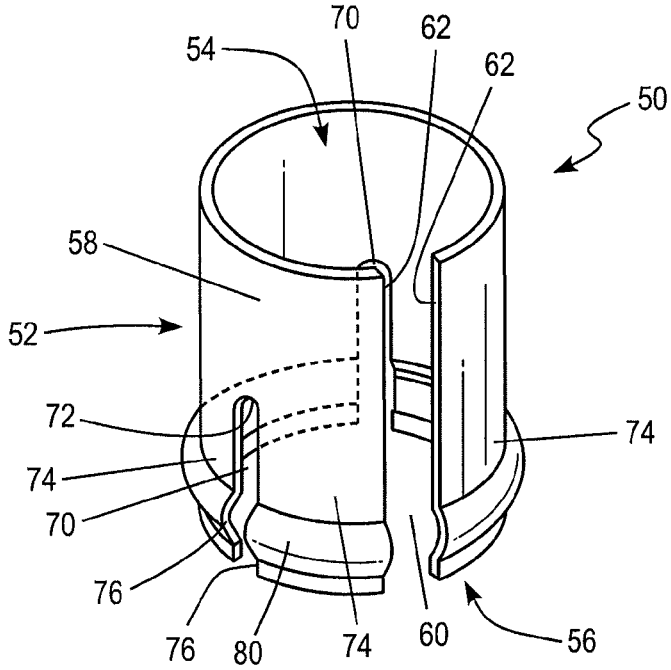
FIG. 2 is an isometric view of an exemplary embodiment of a hybrid retainer sleeve.

A sleeve 50 is arranged about at least a portion of the shank 8 inserted into the bore 34 of the block 30. An exemplary embodiment of a sleeve is shown in FIG. 2. The sleeve 50 includes a hollow cylindrical body 52 having a first end 54, a second end 56 and a connecting surface 58 therebetween arranged axially. The cylindrical body 52 can have any suitable form, such as an elliptical cylindrical body or a right circular cylindrical body. In an exemplary embodiment, the sleeve 50 is formed from a spring steel.

The sleeve 50 includes a plurality of slits formed by the removal of at least some material from the hollow cylindrical body 52. Each of the slits interrupts the generally continuous surface of the hollow cylindrical body 52.

A first axially extending slit 60 in the connecting surface 58 extends from the first end 54 to the second end 56. The first axially extending slit 60 allows circumferential compression of the sleeve 50 from a first circumference at a first radial distance to a second circumference at a second radial distance. At the first circumference, the edges 62 of the first axially extending slit 60 are separated by a distance ($D_1$); at the second smaller circumference, the edges 62 of the first axially extending slit 60 are separated by a distance ($D_2$). The distance $D_1$ is greater than the distance $D_2$. The distance $D_2$ can be zero, i.e., the edges contact each other, along at least a portion of the axial length of the edges 62. During circumferential compression, the general cylindrical form of the sleeve 50 holds, but the circumference is reduced. Similarly, the first axially extending slit 60 allows circumferential expansion of the sleeve 50 from the first circumference at the first radial distance to a larger third circumference at a third radial distance, where the separation distance of the edges 62 is increased along at least a portion of the axial length of the edges 62.

At least one second axially extending slit 70 in the connecting surface 58 extends from the second end 56 to a termination point 72 between the first end 54 and the second end 56. The at least one second axially extending slit 70 divides the second end 56 into a plurality of sections 74 arranged circumferentially at the second end 56. The at least one second axially extending slit 70 allows radial compression of each of the plurality of sections 74 from a first radial distance to a second radial distance. The radial compression for any one section 74 can be independent from any other section 74. At the first radial distance, the edges 76 of the at least one second axially extending slit 70 associated with one section 74 are separated by a distance ($d_1$) from the edges of adjacent sections 74; at the second radial distance, at least a portion of the edges 76 of the at least one second axially extending slit 70 associated with the one section 74 are separated by a distance ($d_2$) from the edges of adjacent sections 74. The distance $d_1$ is greater than the distance $d_2$. The distance $d_2$ can be zero, i.e., the edges contact each other, along at least a portion of the axial length of the edges 76. Typically, the portion where the edges contact will be the portion closest to the second end 56. Similarly, one or more of the sections 74 can be moved radially outward from a first radial distance to a larger third radial distance, where the separation distance of the edges 76 is increased along at least a portion of the axial length of the edges 76. During the compression or expansion, the radial distance of any one of the sections 74 varies, either alone of in conjunction with other sections 74, depending on the forces applied to the sections 74. Therefore, one section 74 can have a reduced radial distance while an adjacent section can have an unchanged or increased radial distance. When all of the plurality of sections 74 move at the same time in the same direction, i.e., radially inward or radially outward, the sections effectively move to reduce or increase the circumference in that portion of the sleeve 50.

The sleeve 50 includes a projected portion 80. The sleeve 50 at the projected portion 80 projects radially outward with a radius larger than a radius of an outer diameter of the hollow cylindrical body 58. The projected portion 80 is offset from the second end 56. For example, the projected portion 80 can be in the sections 74, with the termination point 72 of the second axially extending slit 70 axially closer to the first end 54 than is the projected portion 80. The projected portion 80 can have any suitable geometric form. In an exemplary embodiment and as shown in FIGS. 1 and 2, the projected portion is hemispherical. In other exemplary embodiments, the geometric form can be a circumferentially arranged series of bumps, an angled surface or any other protrusion, as long as the radius of the sleeve 50 at the projected portion 80 is the larger than the radius on the sleeve 50 that would contact the inner surface of the bore when assembled.

As shown in FIG. 1, the shank 8 of the tool 2 is inserted into the bore 34 of the block 30 from the first side 36. The sleeve 50 is positioned about the shank 8 with the connecting surface 58 between the shank 8 and the surface of the bore 34. The second end 56 of the sleeve 50, up to and including the projected portion 80, extends past the bore 34 on the second side 38 of the block 30 with the projected portion 80 of the sleeve 50 abutting the second side 38.

The sleeve utilizes two methods of retention—a friction fit as well as a rear retention.

A friction fit for the sleeve 50 is established by the contact between the connecting surface 58 and the surface of the bore 34. The connecting surfaces 58 are pushed radially outward against the surface of the bore 34 by a spring-like action of the sleeve 50. The spring like-action occurs because the static-state diameter of the sleeve is larger than the diameter of the bore. When the projected portion 80 of the sleeve 50 exits the bore 34 on the second side 38 of the block 30, the connecting surface 58 of the sleeve 50 expands to the diameter of the bore 34. The elastic properties of the sleeve 50 provide for friction retention when installed. Note that the sleeve is depicted in FIG. 1 as being located in only a portion of the bore 34. That is, there is a portion of the shank 8 within the bore 34 that has the sleeve 50 arranged about it and there is another portion of the shank 8 within the bore 34 that does not have a sleeve 50 arranged about it. However, the sleeve 50 can occupy any length or longitudinally extent of the bore 34.

A rear retention for the sleeve 50 is established by the projected portion 80 abutting the second side 38. The geometry of the projected portion 80 urges the tool 2 into the bore 34 of the block 30, i.e., in an axial rearward direction (R). During use, as the tool 2 tries to kick out (and drag the sleeve 50 with it due to the second end 56 of the sleeve 50 contacting stop surface 90 located at the end of the shank 8), the angle ($\alpha$) that starts the projected portion 80 provides, along with the elastic forces of the sleeve, a resistive force that urges the sleeve 50 (and therefore the tool 2) rearward (R). This maximizes tool retention and minimizes slapping between the first side 36 of the block 30, i.e. the face, and the shoulder 14 of the tool 2.

By combining the holding features of a sleeve retainer with retention properties of a rear style retainer, the retention power for the sleeve is increased over designs using only one a friction fit and rear style retainer. The increased retention is more than enough to overcome the vibrations and centrifugal forces inherent in current and planned machine designs.

When assembling the tool 2 into the block 30, the sleeve 50 is preassembled about the shank 8. This can be accomplished, for example, by sliding the sleeve 50, typically in an expanded state, over the stop surface 90 of the shank 8. Once the sleeve 50 is past the stop surface 90, the sleeve 50 returns to the static state. The stop surface 90 prevents the sleeve 50 from coming off the shank unless the sleeve 50 is expanded by some means.

When inserted into the bore 34, the preassembled sleeve 50 is compressed by the surface of the bore 34 bearing on the projected portion 80. In the area of the projected portion 80, the shank 8 has a reduced radius or other accommodation, such as a slot, groove, trench or taper, to allow the sleeve 50 to compress as needed to pass the increased radius of the projected portion 80 through the bore 34.

In an exemplary embodiment, a customer receives the tool 2 with the sleeve 50 already assembled. Thus, the tool 2 comes ready for installation with no loose pieces. Because the tool 2 comes with the sleeve 50 in place, installation is very simple. By using a standard dead-blow hammer, the tool 2 is knocked into the block 30 (or similar holder). Once the projected portion 80 of the sleeve 50 exits the bore 34 on the second side 38 of the block 30, the sleeve 50 expands. The projected portion 80 behaves as a rear retainer and the connecting surfaces 58 act as a friction fit, locking the tool 2 in its block 30 without inhibiting rotation.

This retention method can be used with blocks that have internally grooved bores or smooth bores. Internally grooved bores are not needed for this sleeve, although they will not diminish the performance of the tool or the retention method. When an internally grooved bore is present, the connecting surface of the sleeve bridges the groove. During insertion of the sleeve in a grooved bore, the projected portion may expand into the groove. However, additional force can be used to recompress the sleeve and to continue insertion until the projected portion exits the bore on the second side of the block.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A system for retaining a tool in a block, the system comprising:
- a body with a bore extending from a first side to a second side; and
- a sleeve having
  - a hollow cylindrical body having a first end, a second end and a connecting surface therebetween arranged axially,
  - a first axially extending slit in the connecting surface extending from the first end to the second end,
  - at least one second axially extending slit in the connecting surface extending from the second end to a termination point between the first end and the second end, and
  - a projected portion offset from the second end,
- wherein the sleeve at the projected portion projects radially outward with a radius larger than a radius of an outer diameter of the hollow cylindrical body,
- wherein the termination point is axially closer to the first end than the projected portion, and
- wherein the second end of the hollow cylindrical body up to and including the projected portion extends past the bore on the second side of the body with the projected portion of the sleeve abutting the second side.

2. The system of claim 1, wherein the hollow cylindrical body is circumferentially compressible.

3. The system of claim 2, wherein the at least one second axially extending slit divides the second end into a plurality of sections, and wherein each of the plurality of sections is independently radially compressible.

4. The system of claim 1, wherein, in a static state, the radius of the sleeve at the projected portion is the largest radius on the sleeve.

5. The system of claim 1, wherein the projected portion has a hemispherical form.

6. The system of claim 1, wherein the projected portion includes a circumferentially arranged series of bumps.

7. The system of claim 1, wherein the projected portion is an angled surface.

8. The system of claim 1, wherein the sleeve is formed from a spring steel.

9. The system of claim 1, wherein the cylindrical body is an elliptical cylindrical body.

10. The system of claim 1, wherein the cylindrical body is a right circular cylindrical body.

11. A tool and block assembly, comprising the system of claim 1.

12. A system for retaining a tool in a block, the system comprising:
- a body with a bore extending from a first side to a second side; and
- a sleeve having
  - a hollow cylindrical body having a first end, a second end and a connecting surface therebetween arranged axially,
  - a first axially extending slit in the connecting surface extending from the first end to the second end;

at least one second axially extending slit in the connecting surface extending from the second end to a termination point between the first end and the second end, a plurality of sections formed by the at least one second axially extending slit and the plurality of sections arranged circumferentially at the second end, and a projected portion offset from the second end, wherein the hollow cylindrical body is circumferentially compressible, wherein each of the plurality of sections is independently radially compressible, wherein the second end of the hollow cylindrical body up to and including the projected portion extends past the bore on the second side of the body with the projected portion of the sleeve abutting the second side, wherein the sleeve at the projected portion projects radially outward with a radius larger than a radius of an outer diameter of the hollow cylindrical body, and wherein the termination point is axially closer to the first end than the projected portion.

13. The system of claim 12, wherein the plurality of sections are collectively circumferentially compressible.

14. A mining machine, comprising:

a rotatable member with at least one bore extending from a first side to a second side; and one or more tools mounted on the rotatable member, wherein the one or more tools are mounted with a sleeve including a hollow cylindrical body having a first end, a second end and a connecting surface therebetween arranged axially, a first axially extending slit in the connecting surface extending from the first end to the second end, at least one second axially extending slit in the connecting surface extending from the second end to a termination point between the first end and the second end, a plurality of sections formed by the at least one second axially extending slit and the plurality of sections arranged circumferentially at the second end, and a projected portion offset from the second end, wherein the hollow cylindrical body is circumferentially compressible, wherein each of the plurality of sections is independently radially compressible, wherein the second end of the hollow cylindrical body up to and including the projected portion extends past the bore on the second side of the rotatable member with the projected portion of the sleeve abutting the second side wherein the sleeve at the projected portion projects radially outward with a radius larger than a radius of an outer diameter of the hollow cylindrical body, and wherein the termination point is axially closer to the first end than the projected portion.

15. The mining machine of claim 14, wherein the sleeve has both a friction fit and a rear retention feature.

16. A tool and block assembly, comprising:

a block including a body having a bore extending axially from a first side to a second side;

a tool including a body having a head and a shank; and a sleeve positioned about the shank, wherein the sleeve includes a hollow cylindrical body having a first end, a second end and a connecting surface therebetween arranged axially, a first axially extending slit in the connecting surface extending from the first end to the second end, at least one second axially extending slit in the connecting surface extending from the second end to a termination point between the first end and the second end, a plurality of sections formed by the at least one second axially extending slit and the plurality of sections arranged circumferentially at the second end, and a projected portion offset from the second end, wherein at least a portion of the connecting surface has a friction fit with the bore, wherein the projected portion contacts the block to urge the sleeve rearward, wherein the tool is rotatable, wherein the second end of the hollow cylindrical body up to and including the projected portion extends past the bore on the second side of the block with the projected portion of the sleeve abutting the second side, wherein the sleeve at the projected portion projects radially outward with a radius larger than a radius of an outer diameter of the hollow cylindrical body, and wherein the termination point is axially closer to the first end than the projected portion.

17. The tool and block assembly of claim 16, wherein the hollow cylindrical body is circumferentially compressible, and wherein each of the plurality of sections is independently radially compressible.

18. The tool and block assembly of claim 16, wherein the body includes a stop surface at a distal end of the shank, and wherein the second end of the sleeve contacts the stop surface.

19. A method of mounting a rotatable tool in a bore of a holder, the method comprising:

securing the tool in the bore with a sleeve that provides both a friction fit and a rear retention feature, wherein a portion of the sleeve including the rear retention feature extends past the bore with the rear retention feature abutting a side of the holder, wherein the sleeve is positioned about a shank of the tool, and wherein the sleeve includes:

a hollow cylindrical body having a first end, a second end and a connecting surface therebetween arranged axially;

a first axially extending slit in the connecting surface extending from the first end to the second end;

at least one second axially extending slit in the connecting surface extending from the second end to a termination point between the first end and the second end; and a projected portion offset from the second end, wherein the sleeve at the projected portion projects radially outward with a radius larger than a radius of an outer diameter of the hollow cylindrical body, and wherein the termination point is axially closer to the first end than the projected portion.

20. The method of claim 19, wherein the sleeve further includes:

a plurality of sections arranged circumferentially at the second end, wherein the hollow cylindrical body is circumferentially compressible, and wherein each of the plurality of sections is independently radially compressible.

* * * * *